US009702570B2

(12) United States Patent
Phillips et al.

(10) Patent No.: US 9,702,570 B2
(45) Date of Patent: Jul. 11, 2017

(54) BULKHEAD ASSEMBLIES FOR AIR CONDITIONER UNITS

(71) Applicant: General Electric Company, Schenectady, NY (US)

(72) Inventors: Richard Michael Phillips, Louisville, KY (US); Wilbur Carl Bewley, Jr., Nicholasville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 14/696,522

(22) Filed: Apr. 27, 2015

(65) Prior Publication Data

US 2016/0313014 A1 Oct. 27, 2016

(51) Int. Cl.

| | |
|---|---|
| ***F25D 23/02*** | (2006.01) |
| ***F24F 1/02*** | (2011.01) |
| ***F24F 1/00*** | (2011.01) |
| ***F24F 13/20*** | (2006.01) |
| ***F24F 13/30*** | (2006.01) |

(52) U.S. Cl.

CPC ..... *F24F 1/022* (2013.01); *F24F 1/0007* (2013.01); *F24F 1/027* (2013.01); *F24F 13/20* (2013.01); *F24F 13/30* (2013.01); *F24F 2001/0037* (2013.01); *F24F 2001/0048* (2013.01); *F24F 2001/0051* (2013.01)

(58) Field of Classification Search

CPC .. F24F 1/0007; F24F 1/027; F24F 2001/0037; F24F 2001/0048; F24F 2001/0051

See application file for complete search history.

(56) References Cited

U.S. PATENT DOCUMENTS 3,628,215 A * 12/1971 Everburg ..... A45C 13/005 16/225
6,234,893 B1 5/2001 Meredith
6,497,740 B1 12/2002 Moretti

FOREIGN PATENT DOCUMENTS

KR 10-2004-0040219 5/2004
KR 102007007736 A * 7/2007

OTHER PUBLICATIONS

Translation of KR-1020070077363-A. Retreived Nov. 10, 2016.*

* cited by examiner

*Primary Examiner* — Orlando E Aviles Bosques
(74) *Attorney, Agent, or Firm* — Dority & Manning, P.A.

(57) ABSTRACT

Air conditioner units and bulkhead assemblies for air conditioner units are provided. A bulkhead assembly includes a bulkhead which includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The bulkhead assembly further includes a vent aperture defined in the rear wall, and a vent unit. The vent unit includes a frame, a door, and a hinge rotatably connecting the door to the frame. The frame is positioned on one of the indoor facing surface or the outdoor facing surface and defines a frame aperture generally aligned with the vent aperture. The door is rotatable between an open position and a closed position.

20 Claims, 6 Drawing Sheets

BULKHEAD ASSEMBLIES FOR AIR CONDITIONER UNITS

FIELD OF THE INVENTION

The present disclosure relates generally to air conditioner units, and more particularly to improved venting apparatus for bulkheads of air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

Further, conventional air conditioner units include a bulkhead which is positioned between the indoor portion and outdoor portion, and thus generally separates the components within the indoor portion from the components in the outdoor portion. Various components may additionally be connected to the bulkhead, such as the blower fan and heating unit.

In some cases, it may be desirable to allow outdoor air through the bulkhead into a room into which the air conditioner unit extends. Accordingly, many bulkheads include vent apertures for allowing such airflow. Further, to allow a user to choose whether to allow such outdoor air through the bulkhead, a cap may be provided which can be connected to the bulkhead by a number of screws or removed from the bulkhead via unscrewing of the screws, depending on the preference of the user. Such caps and the use of screws to connect such caps to bulkheads, however, have a number of disadvantages. For example, connecting and disconnecting of a cap is labor intensive and requires disassembly of many component of the air conditioner unit in order to access the screw locations. Further, such caps are separate components which are prone to being lost when disconnected from associated bulkheads.

Accordingly, improved air conditioner units and bulkheads therefor are desired. In particular, venting apparatus for bulkheads of air conditioner units which reduce associated labor requirements and loss risks would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit includes an outdoor heat exchanger, an indoor heat exchanger, and a bulkhead disposed between the outdoor heat exchanger and the indoor heat exchanger along a transverse direction. The bulkhead includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The air conditioner unit further includes a vent aperture defined in the rear wall, and a vent unit. The vent unit includes a frame, a door, and a hinge rotatably connecting the door to the frame. The frame is positioned on one of the indoor facing surface or the outdoor facing surface and defines a frame aperture generally aligned with the vent aperture. The door is rotatable between an open position and a closed position.

In accordance with another embodiment, a bulkhead assembly for an air conditioner unit is provided. The bulkhead assembly includes a bulkhead which includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The bulkhead assembly further includes a vent aperture defined in the rear wall, and a vent unit. The vent unit includes a frame, a door, and a hinge rotatably connecting the door to the frame. The frame is positioned on one of the indoor facing surface or the outdoor facing surface and defines a frame aperture generally aligned with the vent aperture. The door is rotatable between an open position and a closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
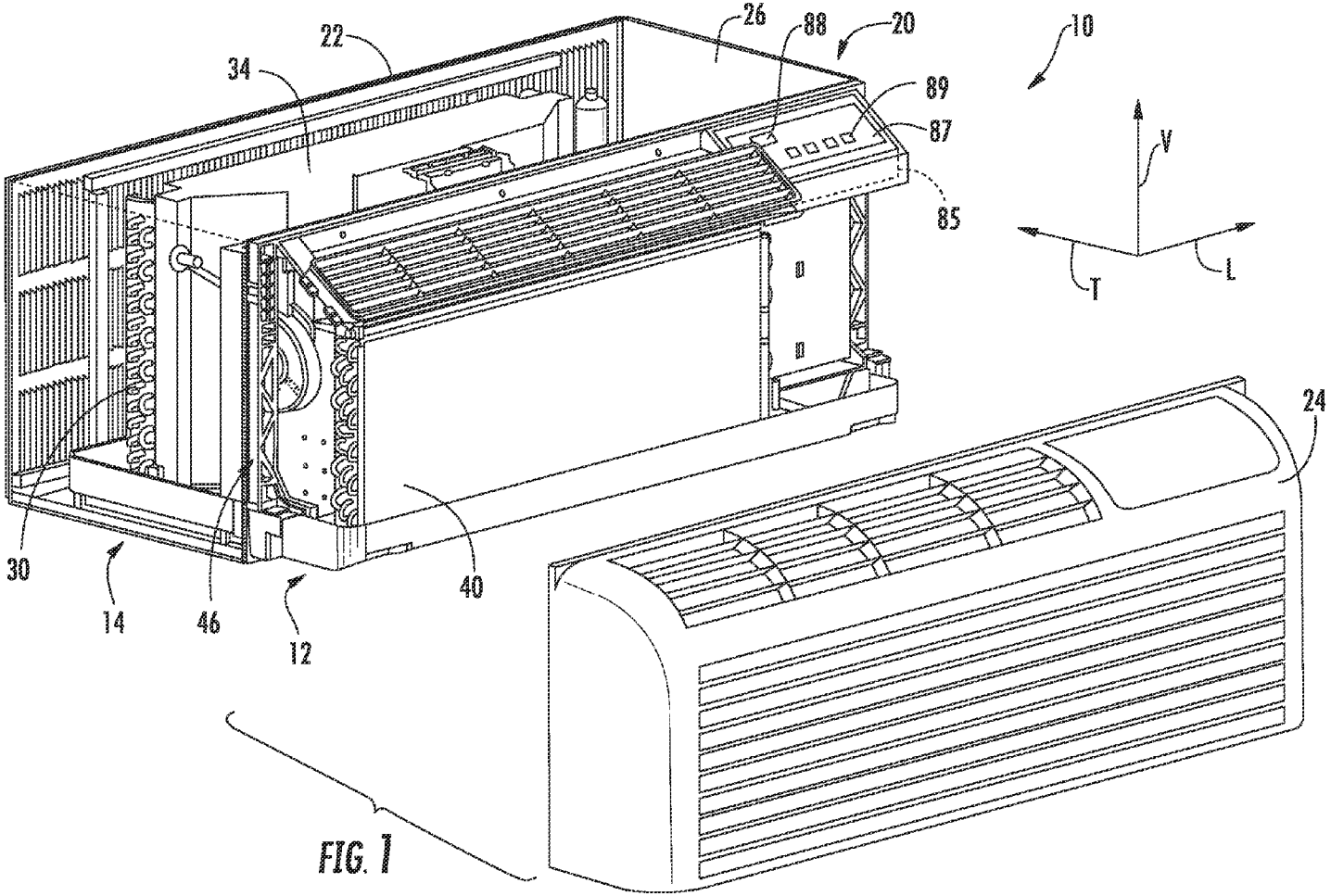
FIG. 1 provides a perspective view of an air conditioner unit, with a room front exploded from a remainder of the air conditioner unit for illustrative purposes, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction by a wall sleeve 26. The rear grill 22 may be part of the outdoor portion 14, which the room front 24 is part of the indoor portion 12. Components of the outdoor portion 14, such as an outdoor heat exchanger 30, outdoor fan (not shown), and compressor (not shown) may be housed within the wall sleeve 26. A casing 34 may additionally enclose the outdoor fan, as shown.

Figure 2:
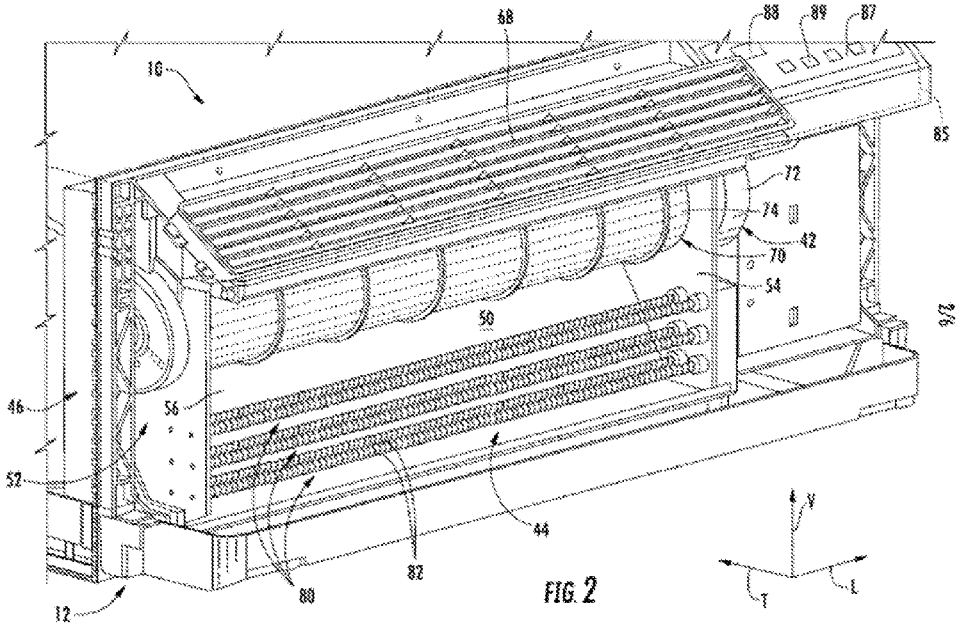
FIG. 2 is a perspective view of components of an indoor portion of an air conditioner unit in accordance with one embodiment of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Bulkhead 46 may include various peripheral surfaces that define an interior 50 thereof. For example, and additionally referring to FIGS. 3 through 5, bulkhead 46 may include a first sidewall 52 and a second sidewall 54 which are spaced apart from each other along the lateral direction L. A rear wall 56 may extend laterally between the first sidewall 52 and second sidewall 54. The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may additionally include, for example, an air diverter 68, which may extend between the sidewalls 52, 54 along the lateral direction L and which may flow air therethrough.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

Heating unit 44 in exemplary embodiments includes one or more heater banks 80. Each heater bank 80 may be operated as desired to produce heat. In some embodiments as shown, three heater banks 80 may be utilized. Alternatively, however, any suitable number of heater banks 80 may be utilized. Each heater bank 80 may further include at least one heater coil or coil pass 82, such as in exemplary embodiments two heater coils or coil passes 82. Alternatively, other suitable heating elements may be utilized.

The operation of air conditioner unit 10 including blower fan 42, heating unit 44, and other suitable components may be controlled by a processing device such as a controller 85. Controller 85 may be in communication (via for example a suitable wired or wireless connection) to such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example be a touchscreen or other text-readable display screen, or alternatively may simply be a light that can be activated and deactivated as required to provide an indication of, for example, an event or setting for the unit.

Figure 3:
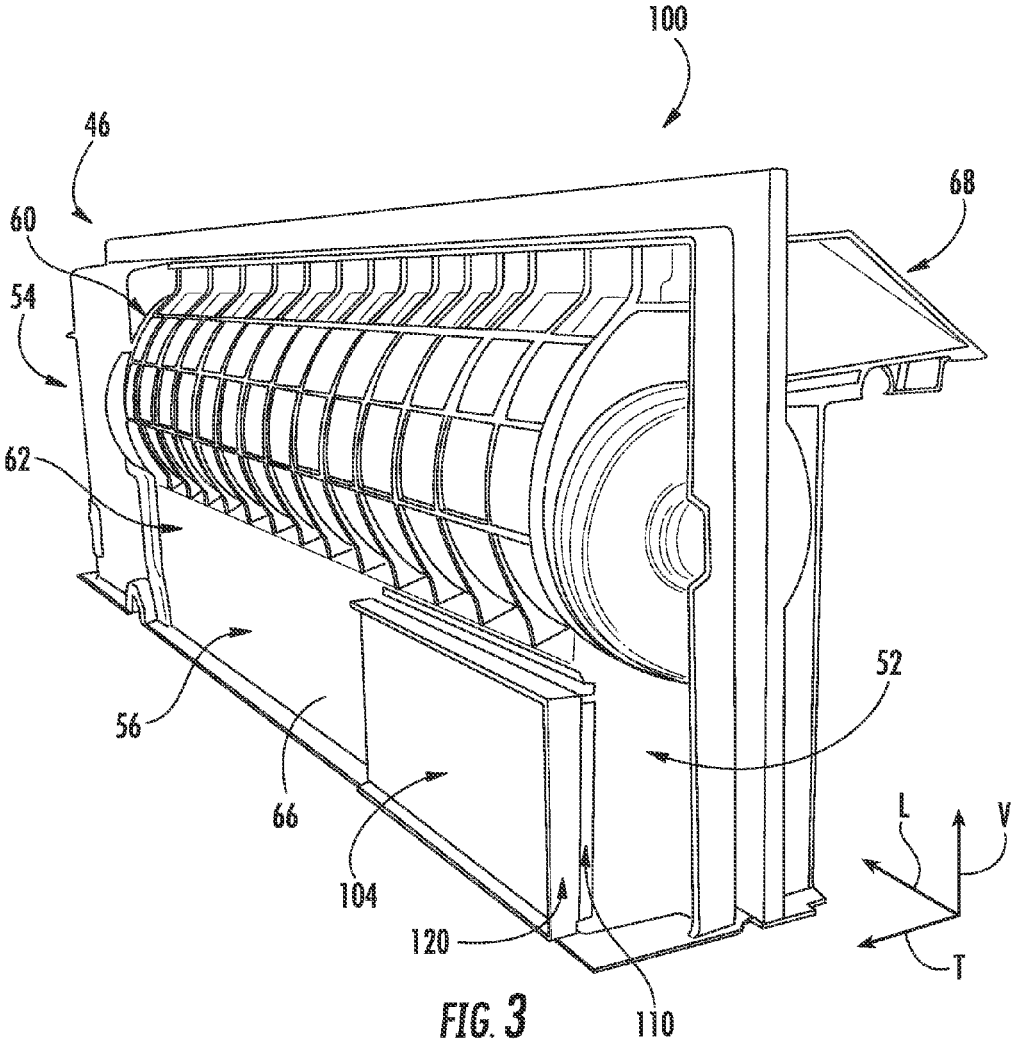
FIG. 3 is a rear perspective view of a bulkhead and vent unit, with a door of the vent unit closed, in accordance with one embodiment of the present disclosure.
Figure 4:
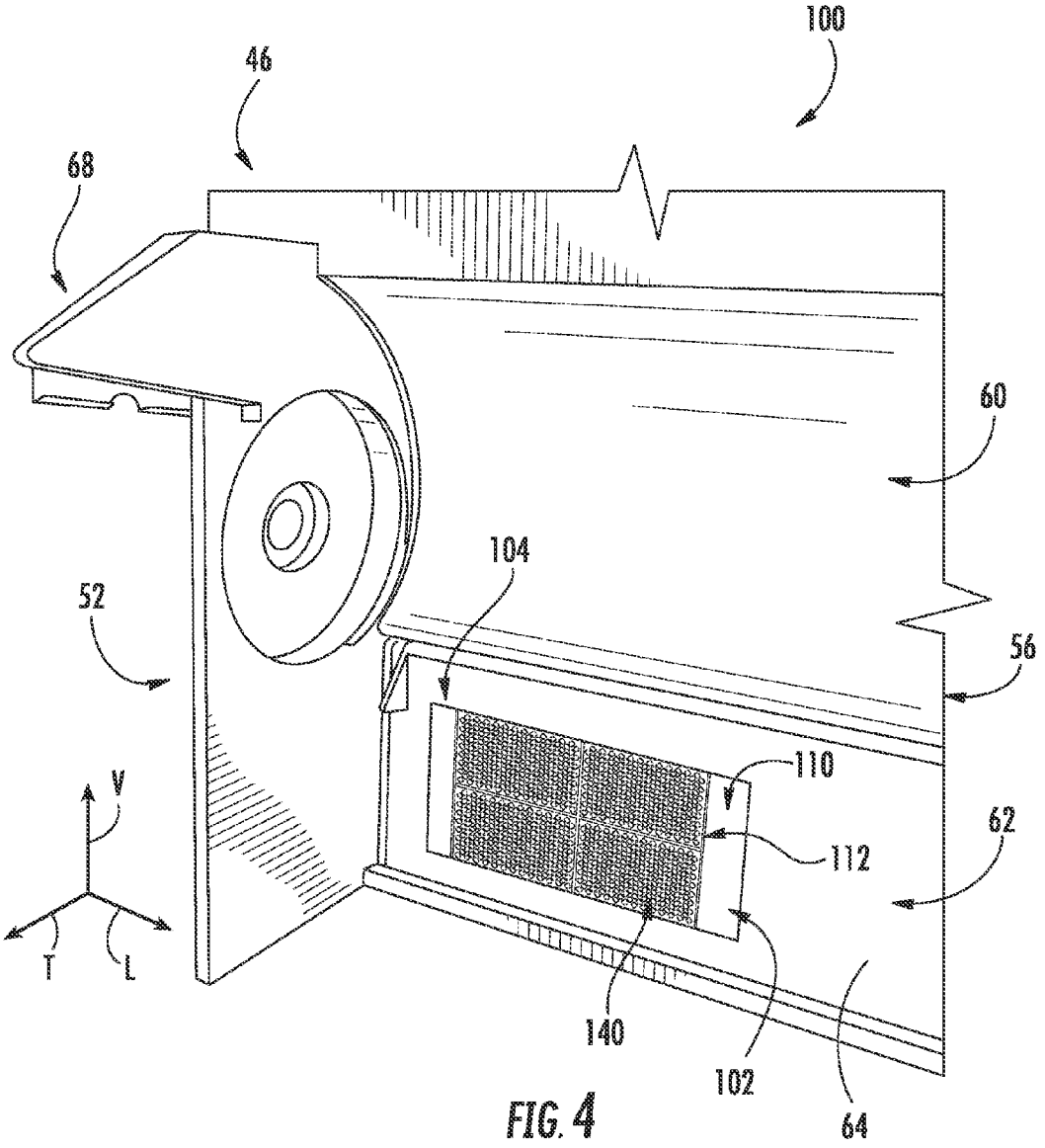
FIG. 4 is a front perspective view of a bulkhead and vent unit, with a door of the vent unit closed, in accordance with one embodiment of the present disclosure.
Figure 5:
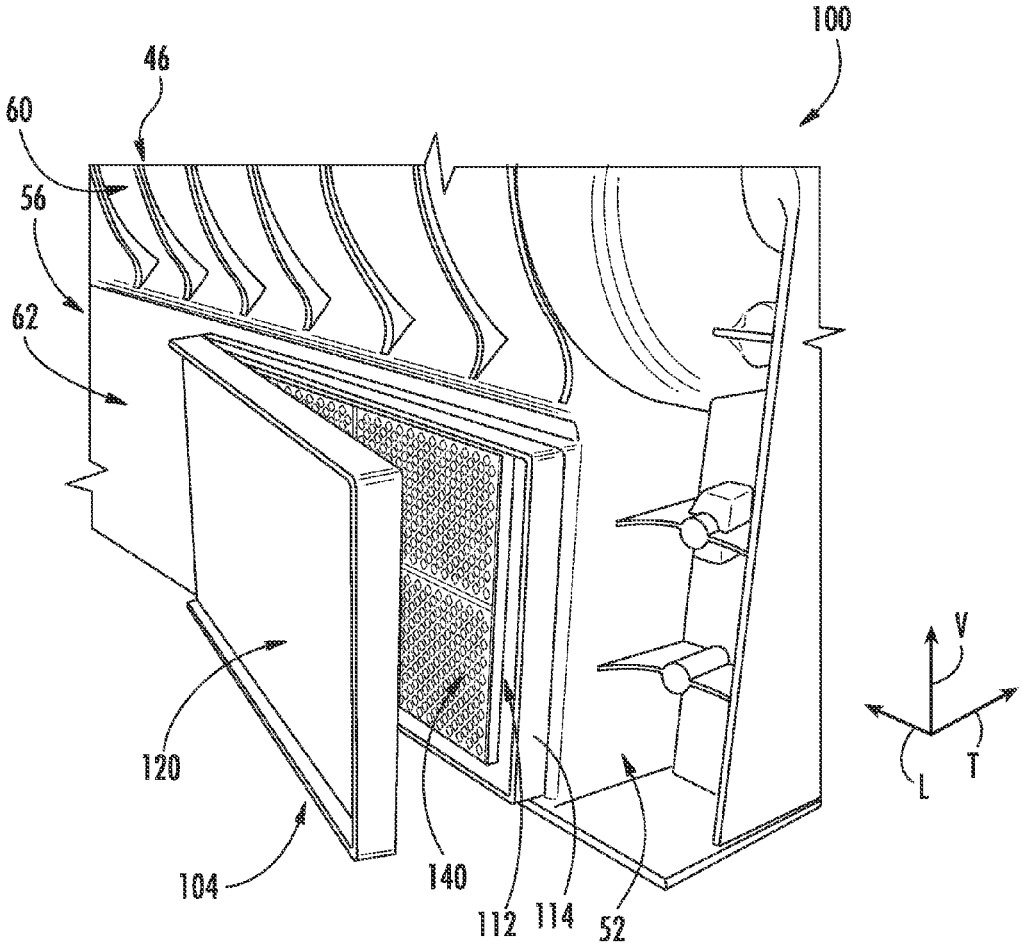
FIG. 5 is a rear perspective view of a bulkhead and vent unit, with a door of the vent unit open, in accordance with one embodiment of the present disclosure.
Figure 6:
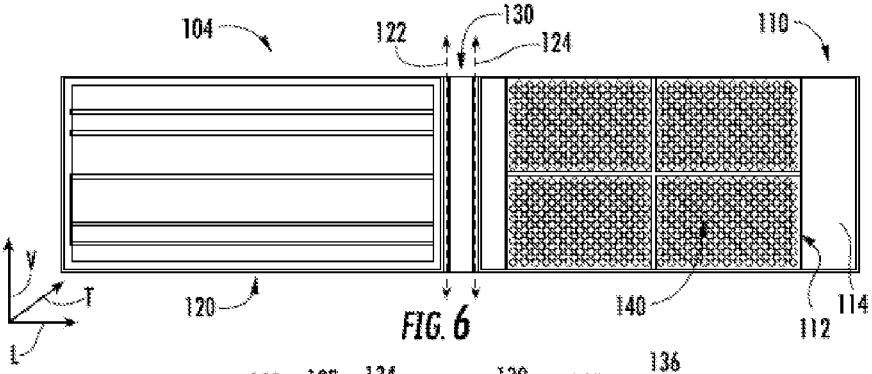
FIG. 6 is a front view of a vent unit, with a door of the vent unit open, in accordance with one embodiment of the present disclosure.

Referring now to FIGS. 3 through 5, embodiments of a bulkhead assembly 100 which includes a bulkhead 46 are illustrated. As discussed, bulkhead 46 includes a first side sidewall 52 and second side sidewall 54, as well as a rear wall 56 extending therebetween. Further, a vent aperture 102 may be defined in the rear wall 56. Vent aperture 102 may allow air flow therethrough between the indoor portion 12 and outdoor portion 14, and may be utilized in an installed air conditioner unit 10 to allow outdoor air to flow therethrough into the indoor portion 12.

To allow a user to determine whether air flow through the vent aperture 102 is desired, and to allow the user to permit or restrict such air flow as desired, a vent unit 104 may be included in air conditioner unit 10. Referring now to FIGS. 3 through 8, vent unit 104 may include a frame 110, a door 120, and a hinge 130 rotatably connecting the frame 110 and the door 120.

Frame 110 may define a frame aperture 112 between frame member(s) 114 which form the frame 110. The frame 110 may, for example, be generally rectangular, oval, or any other suitable polygonal shape, thus defining a rectangular, oval, or any other suitable polygonal shaped frame aperture 112. The frame 110 may be positioned on one of the indoor facing surface 64 or the outdoor facing surface 66 of the rear wall 56 (such as the outdoor facing surface 66 as shown), and may be positioned such that the frame aperture 112 is generally aligned with the vent aperture 102. Accordingly, when a door 120 of the vent unit 104 is in an open position as discussed herein, air flow through the vent aperture 102 may also flow through the frame aperture 112.

As discussed, door 120 is connected to frame 110 by a hinge 130. Advantageously, door 120 may be rotatable between a closed position, as illustrated in FIGS. 3 and 4, and an open position, as illustrated in FIG. 5. In the closed position, the door 120 generally contacts the frame 110 and restricts or prevents air flow through the frame 110, such as through the frame aperture 112. Accordingly, little or no air flow through the vent aperture 102 from the outside portion 14 to the inside portion 12 or from the inside portion 12 to the outside portion 14 is permitted. In the open position, the door 120 is generally spaced from the frame 110 and rotated away from the frame 110 such that air flow through the frame 110, such as through the frame aperture 112, is allowed. Accordingly, air flow through the vent aperture 102 from the outside portion 14 to the inside portion 12 or from the inside portion 12 to the outside portion 14 is allowed.

The use of a hinge 130 to connect door 120 and frame 110 provides numerous advantages for the associated bulkhead 46 and air conditioner unit 10. For example, door 120 may be easily opened by rotating the door 120 from a closed position to an open position and easily closed by rotating the door 120 from an open position to a closed position with significantly less labor than required for vent apertures 102 of presently known bulkheads 46. Further, when the door 120 is opened, it advantageously remains connected to the frame 110, thus ensuring that the door 120 will not be lost. Still further, use of vent units 104 in accordance with the present disclosure may reduce unit 10 assembly costs and times, by advantageously reducing and simplifying the number of components required for venting operations in bulkheads 46.

Frame 110, door 120 and hinge 130 may, in exemplary embodiments as shown, be integral with each other and thus formed as a single, unitary component. Alternatively, however, these components may be formed separately and coupled together to form vent unit 104.

Further, in exemplary embodiments, hinge 130 is a living hinge. A living hinge is a thin, flexible hinge made from the same material as the two rigid components that it connects. For example, the vent unit 104, and thus the frame 110, door 120 and hinge 130 thereof, may in exemplary embodiments be formed from plastics, such as a polyethylene or polypropylene. Alternatively, the vent unit 104, and thus the frame 110, door 120 and hinge 130 thereof, may be formed from metals or other suitable materials. In exemplary embodiments the same material is utilized for the frame 110, door 120 and hinge 130.

Figure 7:
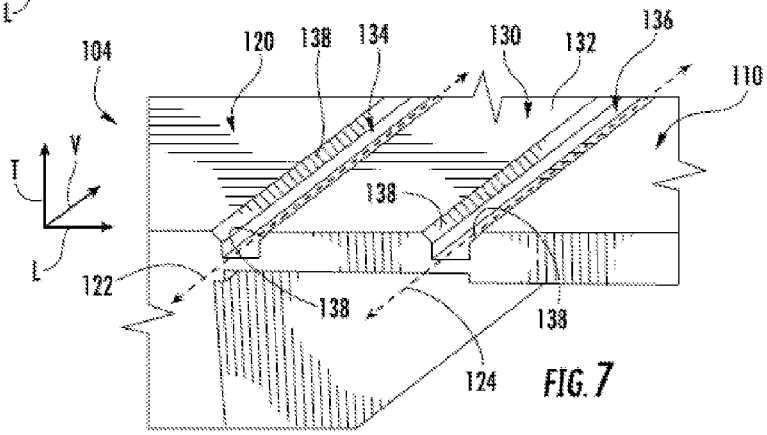
FIG. 7 is a bottom perspective view of a hinge extending between a frame and a door of a vent unit, with the door in an open position, in accordance with one embodiment of the present disclosure.
Figure 8:
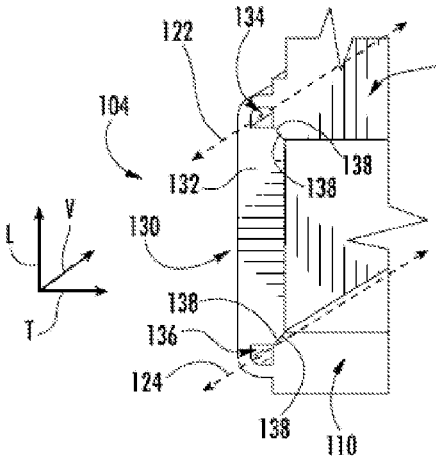
FIG. 8 is a bottom perspective view of a hinge extending between a frame and a door of a vent unit, with the door in an closed position, in accordance with one embodiment of the present disclosure.

As discussed, door 120 may be rotatable between an open position and a closed position. In exemplary embodiments, door 120 may be rotatable about a rotational axis 122, such as a first rotational axis 122, that is generally parallel to the vertical direction V as shown. Alternatively, however, door 120 may be rotatable about a rotational axis that is generally parallel to the transverse direction T or another suitable direction such as between the vertical direction V and transverse direction T. Further, in exemplary embodiments as shown in FIGS. 7 and 8, door 120 may be rotatable relative to hinge 130, and hinge 130 may be rotatable relative to frame 110. For example, hinge 130 may be rotatable about a second rotational axis 124. Notably, second rotational axis 124 may be generally parallel to the first rotational axis 122, as shown.

FIGS. 7 and 8 illustrate one embodiment of a hinge 130 connecting a door 120 and frame 110 in an open position (FIG. 7) and a closed position (FIG. 8). As mentioned, in these embodiments, door 120 is rotatable relative to hinge 130, and hinge 130 is rotatable relative to frame 110. Hinge 130 may, for example, include a panel 132 extending between the frame 110 and the door 120. Further, a first channel 134 may be defined in the panel 132 proximate the door 120, and a second channel 136 may be defined in the panel 132 proximate the frame 110. The first channel 134 and second channel 136 may facilitate rotation of the door 120 relative to the hinge 130 and rotation of the hinge 130 relative to the frame 110, by allowing the panel 132 material defining the channels 134, 136 to bend as required. Additionally, chamfers 138 or other surface cutaway features may be provided and defined on the surfaces of the door 130, panel 132 and frame 110 proximate the channels 134, 136 to further facilitate rotation and allow complete closing of the door 120 relative to the frame 110.

It should be noted that, in some embodiments, a filter 140 may be utilized in conjunction with vent unit 104 to generally filter the air flow through the vent aperture 102 and frame aperture 112. Any suitable filter 140 material may be utilized, such as for example a filter 140 having a polypropylene frame and a polypropylene filter mesh. The filter 140 may extend across the frame aperture 112 as shown to provide filtering of the air flow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an outdoor heat exchanger;

an indoor heat exchanger;

a bulkhead disposed between the outdoor heat exchanger and the indoor heat exchanger along a transverse direction, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a vent aperture defined in the rear wall; and a vent unit, the vent unit comprising a frame, a door, and a hinge rotatably connecting the door to the frame, the frame positioned on one of the indoor facing surface or the outdoor facing surface and defining a frame aperture aligned with the vent aperture, the door rotatable between an open position and a closed position, the hinge comprising a panel extending between the door and the frame, the panel defining a first channel and a second channel, the first channel proximate the door, the second channel proximate the frame, wherein the panel comprises a first chamfer surface and a second chamfer surface spaced apart from the first chamfer surface along the lateral direction, the first chamfer positioned adjacent the first channel, the second chamfer positioned adjacent the second channel.

2. The air conditioner unit of claim 1, wherein the hinge is a living hinge.

3. The air conditioner unit of claim 1, wherein the frame, the door and the hinge are integral with each other.

4. The air conditioner unit of claim 1, wherein the frame is positioned on the outdoor facing surface.

5. The air conditioner unit of claim 1, wherein the door is rotatable about a rotational axis that is parallel to a vertical direction.

6. The air conditioner unit of claim 1, wherein the door is rotatable relative to the hinge and the hinge is rotatable relative to the frame.

7. The air conditioner unit of claim 1, further comprising a filter extending across the frame aperture.

8. The air conditioner unit of claim 1, wherein the vent unit is formed from a plastic.

9. The air conditioner unit of claim 1, wherein the bulkhead further comprises an air diverter extending laterally between the first sidewall and the second sidewall.

10. The air conditioner unit of claim 1, further comprising a blower fan and a heating unit each disposed at least partially within an interior of the bulkhead.

11. The air conditioner unit of claim 1, wherein the door comprises a chamfer surface positioned adjacent the first channel, and wherein the frame comprises a chamfer surface positioned adjacent the second channel.

12. A bulkhead assembly for an air conditioner unit, the bulkhead assembly comprising:

a bulkhead, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a vent aperture defined in the rear wall; and a vent unit, the vent unit comprising a frame, a door, and a hinge rotatably connecting the door to the frame, the frame positioned on one of the indoor facing surface or the outdoor facing surface and defining a frame aperture aligned with the vent aperture, the door rotatable between an open position and a closed position, the hinge comprising a panel extending between the door and the frame, the panel defining a first channel and a second channel, the first channel proximate the door, the second channel proximate the frame, wherein the panel comprises a first chamfer surface and a second chamfer surface spaced apart from the first chamfer surface along the lateral direction, the first chamfer positioned adjacent the first channel, the second chamfer positioned adjacent the second channel.

13. The bulkhead assembly of claim 12, wherein the hinge is a living hinge.

14. The bulkhead assembly of claim 12, wherein the frame, the door and the hinge are integral with each other.

15. The bulkhead assembly of claim 12, wherein the frame is positioned on the outdoor facing surface.

16. The bulkhead assembly of claim 12, wherein the door is rotatable about a rotational axis that is parallel to a vertical direction.

17. The bulkhead assembly of claim 12, wherein the door is rotatable relative to the hinge and the hinge is rotatable relative to the frame.

18. The bulkhead assembly of claim 12, further comprising a filter extending across the frame aperture.

19. The bulkhead assembly of claim 12, wherein the vent unit is formed from a plastic.

20. The bulkhead assembly of claim 12, wherein the door comprises a chamfer surface positioned adjacent the first channel, and wherein the frame comprises a chamfer surface positioned adjacent the second channel.

* * * * *